United States Patent [19]

Weeks

[11] Patent Number: 4,741,397

[45] Date of Patent: May 3, 1988

[54] JET PUMP AND TECHNIQUE FOR CONTROLLING PUMPING OF A WELL

[75] Inventor: Benjamin R. Weeks, Corpus Christi, Tex.

[73] Assignee: Texas Independent Tools & Unlimited Services, Incorporated, Corpus Christi, Tex.

[21] Appl. No.: 941,685

[22] Filed: Dec. 15, 1986

[51] Int. Cl.[4] ..... E21B 43/00

[52] U.S. Cl. ..... 166/250; 166/53; 166/68; 166/369; 417/18

[58] Field of Search ..... 166/53, 68, 68.5, 72, 166/105, 250, 369, 370; 417/38, 44, 18

[56] References Cited

U.S. PATENT DOCUMENTS

| | | | |
|---|---|---|---|
| 828,680 | 8/1906 | Quick | 166/53 |
| 1,547,197 | 7/1925 | Arbon | 166/370 |
| 2,146,798 | 2/1939 | Davidson | 166/68.5 |
| 2,765,742 | 10/1956 | King | 166/105 |
| 3,247,798 | 4/1966 | Glasgow et al. | 166/68.5 |
| 4,345,647 | 8/1982 | Carmichael | 166/68.5 |
| 4,369,839 | 1/1983 | Freeman et al. | 166/53 |
| 4,508,488 | 4/1985 | Pikna | 417/44 |
| 4,529,364 | 7/1985 | Schaefer | 166/68.5 |

*Primary Examiner*—Stephen J. Novosad
*Assistant Examiner*—Bruce M. Kisliuk
*Attorney, Agent, or Firm*—G. Turner Moller

[57] ABSTRACT

A surface installation exhausts gas from the annulus of a pumping oil well. The installation includes a tank containing fresh water, a pump-motor arrangement taking fresh water from the tank and delivering it to a jet pump having a suction inlet connected to the annulus and an outlet delivering gas and fresh water back into the tank. The tank acts to separate the gas from the fresh water and vents the gas through a vent tube. The suction pressure of the jet pump is monitored and turns on the oil well pumping unit when the pressure at the jet pump suction declines to a predetermined low value. After the pump is turned on, the pressure at the jet pump suction rises. When it rises to a predetermined value, the oil well pumping unit is turned off.

14 Claims, 3 Drawing Sheets

JET PUMP AND TECHNIQUE FOR CONTROLLING PUMPING OF A WELL

This invention relates to a jet pump arrangement to be placed at the surface of a pumping well and a technique for controlling pumping of the well.

It is old and well known to place vacuum pumps at the surface of a pumping well and connect the pump suction to the annulus between the tubing and casing to reduce the back pressure on the well. The theory is that by reducing the pressure in the annulus at the surface, the fluid head acting against the formation is reduced so that the flow of formation fluids is relatively unimpeded. At one time, vacuum installations were very popular but, in recent years, they have become almost nonexistent. There appear to be a variety of reasons, ranging from regulatory restrictions to the cost of electricity to drive the vacuum pump.

There have been a variety of types of vacuum pumps used in these surface installations including ordinary reciprocating piston type pumps and the jet pump shown in U.S. Pat. No. 2,146,798.

The surface installation of this invention includes a tank for containing a suitable power liquid, such as fresh water. Preferably, the tank is a conventional 55 gallon drum having an open top closed by an ordinary lid. A pump-motor arrangement is mounted on the lid and includes an inlet comprising a conduit extending downwardly into the tank and having a check or foot valve at the lower end thereof. The pump discharge connects to a power fluid nozzle of desirable configuration threaded into one leg of a conventional tee. The opposite leg of the tee connects to a nipple constituting a throat of a jet pump. The offset leg of the tee connects to a conduit leading to the casing of the adjacent pumping well to exhaust gas therefrom. The nipple connects to a swedge type ell, comprising a diffuser of the jet pump, leading to a conduit extending downwardly into the drum. The drum acts as a reservoir for the circulated power fluid and also acts as a gas-liquid separator and allows any gas drawn from the well annulus to escape, preferably through an elevated vent tube above the level of the motor.

The assembly of this invention is normally used on low pressure pumping oil wells of the stripper variety, i.e. low volume pumping wells producing less than 10 barrels of oil per day and usually much less, such as 1–3 barrels of oil per day and having a bottom hole flowing pressure of less than 100 psig. The vacuum produced is normally successful to raise production significantly. Stripper wells of this type are normally pumped with an electric motor driven pump jack at the surface acting through a sucker rod string extending into the well to manipulate a downhole piston type pump. Because the wells do not produce sufficient fluid to keep the pump loaded during continuous operation, a clock type switch is typically provided to shut the pump down for some predetermined interval to allow the well bore to fill up with formation fluid. This down period ends when the clock turns the pump back on and it pumps for another predetermined interval. This on-off cycle saves wear and tear on the equipment as well as electricity. One difficulty is that the on-off periods are predetermined and bear no direct relationship to when the well fills up or empties. Ideally, the pump should be turned on in response to the casing filling up, not in response to the lapse of a predetermined time. Similarly, the well should be turned off when it quits pumping liquid, not when the clock says so.

In some situations, elaborate pump on and pump off devices are incorporated in wells pumped with conventional pump jacks. These devices include strain gauges on the sucker rod string to measure rod load and can accurately determine when the well has pumped off and when it is desired to shut the pump off. Whether these devices accurately determine when to turn the pump on is a matter of dispute. In any event, these type devices are exquisitely expensive and are therefore not applicable to stripper type wells where operations must be inexpensive.

Installation and observation of the operation of the surface assembly of this invention has revealed several unusual events. When the well pumping unit is shut off, the vacuum measured at the surface adjacent the assembly of this invention increases, i.e. suction pressure at the pump inlet declines. When the well begins pumping, the vacuum measured adjacent the assembly of this invention declines, i.e. suction pressure increases toward atmospheric. In several observed installations, the suction pressure increases to a vacuum of 5–6" of mercury after the well pumped for quite a long time from a vacuum of 24" of mercury when pumping began. In other observed wells, the well pumped off when the sensed vacuum reached 5–6" of mercury. The phrase the "well pumped off" means that little or no liquid was pumped from the well even though the pumping mechanism continued operation.

How much the pressure at the pump inlet increases during pumping is manifestly a factor of how much gas a particular well makes as the liquid level therein is lowered because one characteristic of jet pumps is that they produce higher vacuums at lower volumes through the inlet. Thus, as the gas produced from the annulus increases, the vacuum at the pump inlet declines and approaches atmospheric. Thus, in accordance with one aspect of this invention, the on-off periods of a pumping well are controlled by monitoring a parameter of the mechanism used to exhaust gas from the annulus. Preferably, the suction pressure at the inlet of the jet pump is sensed. When the sensed suction pressure is at a predetermined low value, the pump is turned on from an off position. After the sensed suction pressure rises to a predetermined high value, the pumped is turned off from an on position.

It is accordingly an object of this invention to provide an improved installation for use at the surface of a pumping oil well to reduce the pressure in the annulus and thereby reduce the back pressure on the producing formation.

Another object of this invention is to provide an improved apparatus and technique for controlling pump on and/or pump off of a pumping oil well by monitoring a condition of an mechanism to exhaust gas from the annulus of the well.

Other objects and advantages of this invention will become more fully apparent as this description proceeds, reference being made to the accompanying drawings and appended claims.

Figures 1, 4, 5:
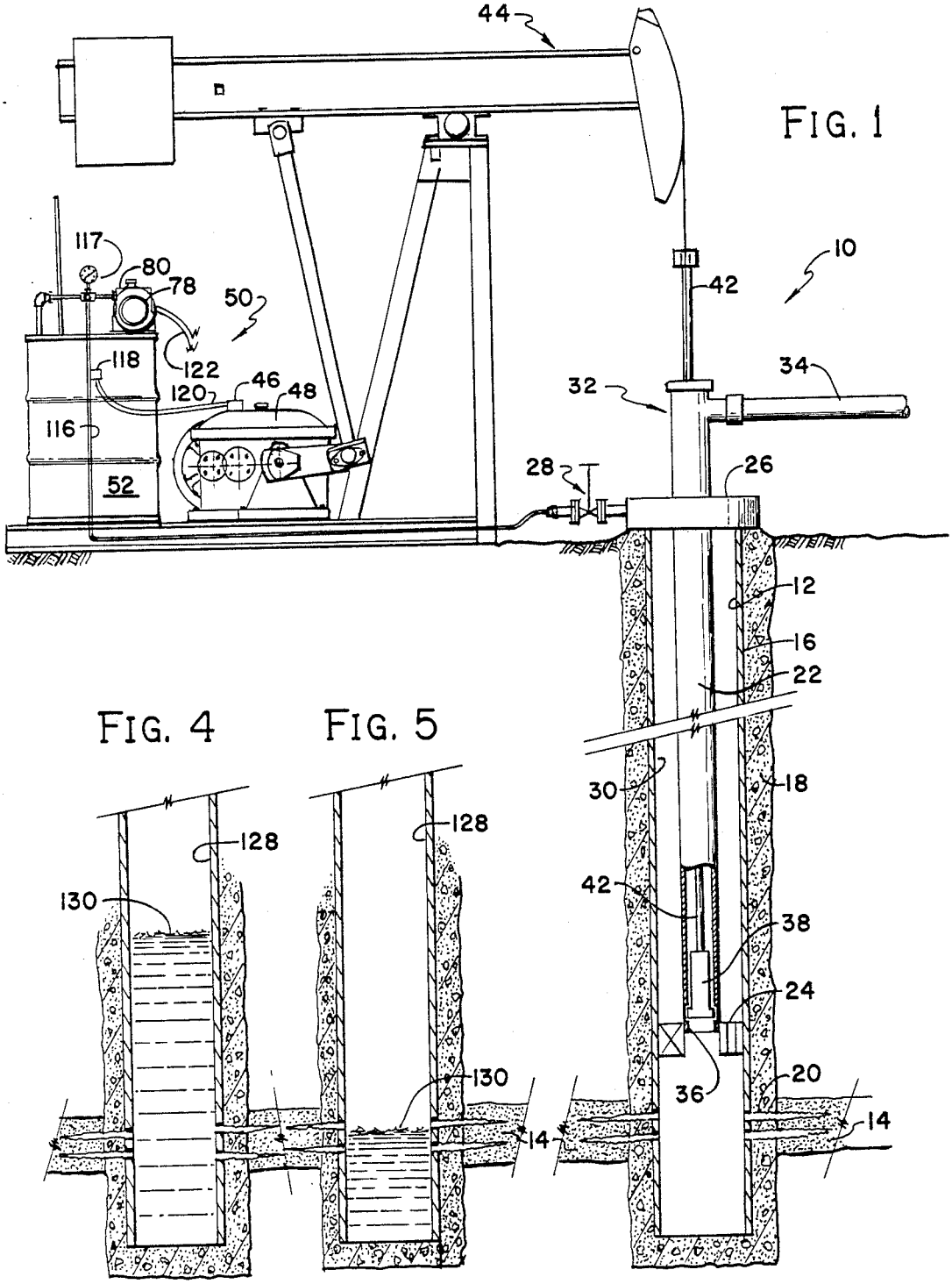
FIG. 1 is a longitudinal cross-sectional view of a pumping oil well equipped with a surface installation of this invention.
FIGS. 4 and 5 are schematic representations of what happens during pumping and fill up of a well.

Referring to FIG. 1, a pumping oil well 10 comprises a bore hole 12 extending into the earth to a depth sufficient to penetrate an oil producing subterranean formation 14. A casing string 16 has been cemented in the bore hole 12 with a cement sheath 18 in a conventional manner. After the casing string 16 has been cemented, a conventional perforating gun (not shown) is used to provide a series of perforations 20 communicating between the formation 14 and the interior of the casing string 16. Typically, the casing string 16 extends below the producing formation 14 to provide what is known as a rat hole. Typically, the rat hole extends at least 30' below the formation 14 and preferably is considerably longer.

A tubing string 22 is run into the well 10 and may include a hold down or gas anchor 24 adjacent the lower end thereof. In the alternative, the tubing string 22 may merely be suspended inside the casing string 16. The tubing string 22 may include conventional API tubing joints having a pin on one end and a collar on the other. The bottom of the tubing string 22 is typically placed slightly above the perforations 20, as illustrated, or is preferably placed in the rat hole so that, when the well pumps off, the casing string 16 is empty or nearly so.

At the surface, the tubing string 22 is suspended from a well head 26 of any suitable type. A valved connection 28 provides communication with the annulus 30 between the casing and tubing strings 16, 22. A pumping tee 32 is used to control pressure in the tubing string and direct pumped formation liquid into a flow line 34 to a suitable tank battery.

The tubing string 22 typically includes a seating nipple 36 at the lower end thereof to receive a downhole pump 38 therein. The pump 38 is of conventional design and includes a standing valve (not shown) to prevent formation fluid from draining out of the bottom of the pump 38 during periods of inactivity.

A sucker rod string 42 extends from the pump 38, through the pumping tee 32 and stuffing box (not shown) therein, to a pump jack arrangement 44 of any suitable type. The purpose of the pump jack arrangement 44 is to reciprocate the sucker rod string 42 thereby manipulating the pump 38 and pumping formation liquid up the tubing string 22. Typically, the formation 16 does not produce sufficient liquid to keep the pump 38 loaded during continuous operation. Thus, in a standard installation, a clock mechanism (not shown) activates a switch or relay 46 to deliver electricity to a motor 48 running the pump jack arrangement 44 and then shut off the electricity thereto. The duration of pumping, and of non-pumping, is typically varied when the well 10 is first put on pump to maximize production and is normally not tinkered with much thereafter. When the pump motor 48 is off, formation liquid enters the casing string 16 and rises far above the pump 38. When the pump motor 48 turns on, the pump 38 is activated and commences pumping liquid up the tubing thereby lowering the liquid level in the casing string 16. Sooner or later, the pump motor 48 turns off, as controlled by the clock. The pump motor 48 may or may not be turned off before the well pumps off, i.e. quite delivering liquid through the flow line 34 even though the pump jack 44 is still operating. As will be apparent to those skilled in the art, the well 10, as heretofore described, comprises a typical pumping oil well.

Figure 2:
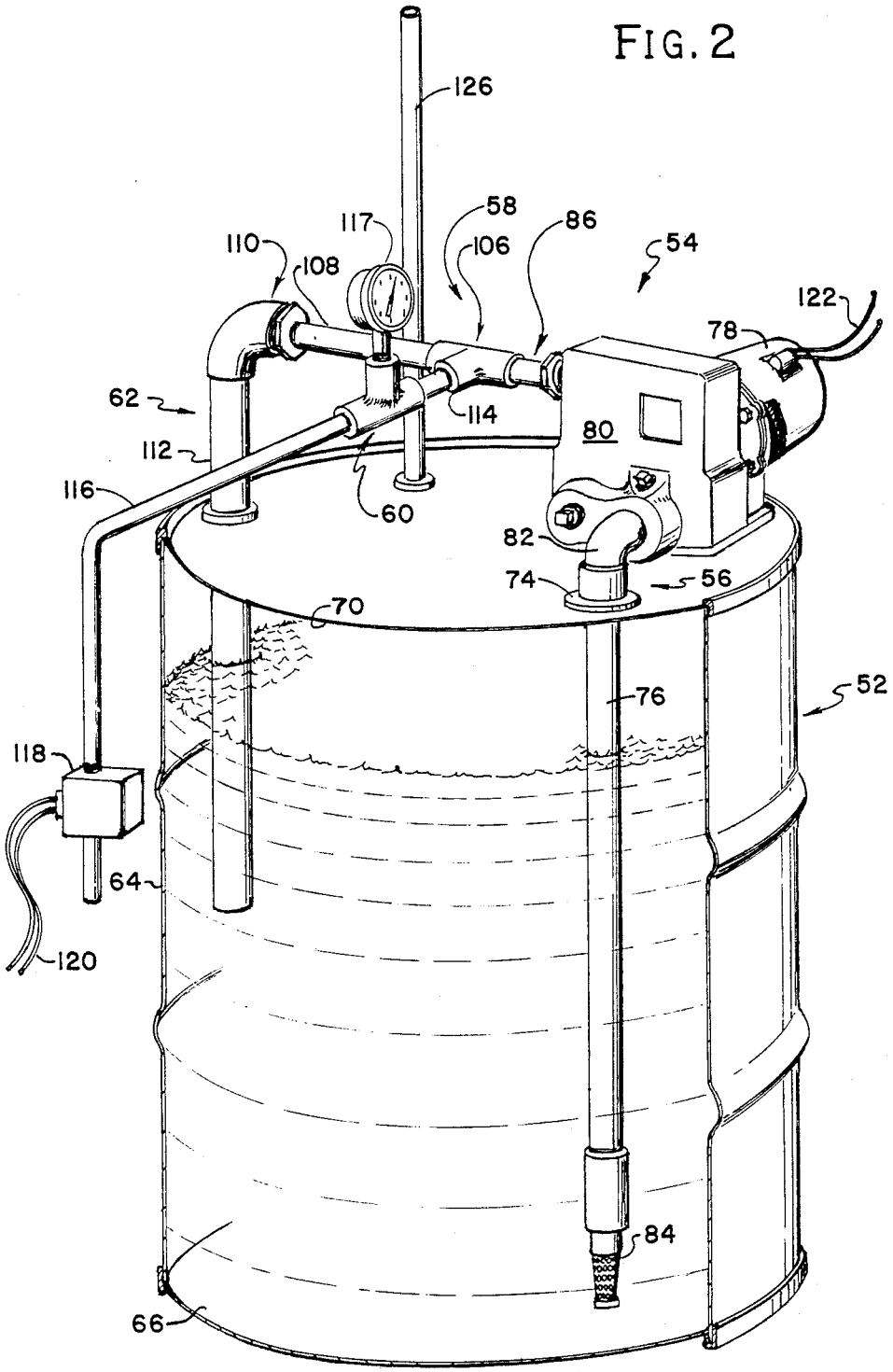
FIG. 2 is an isometric view of the surface installation of this invention.
Figure 3:
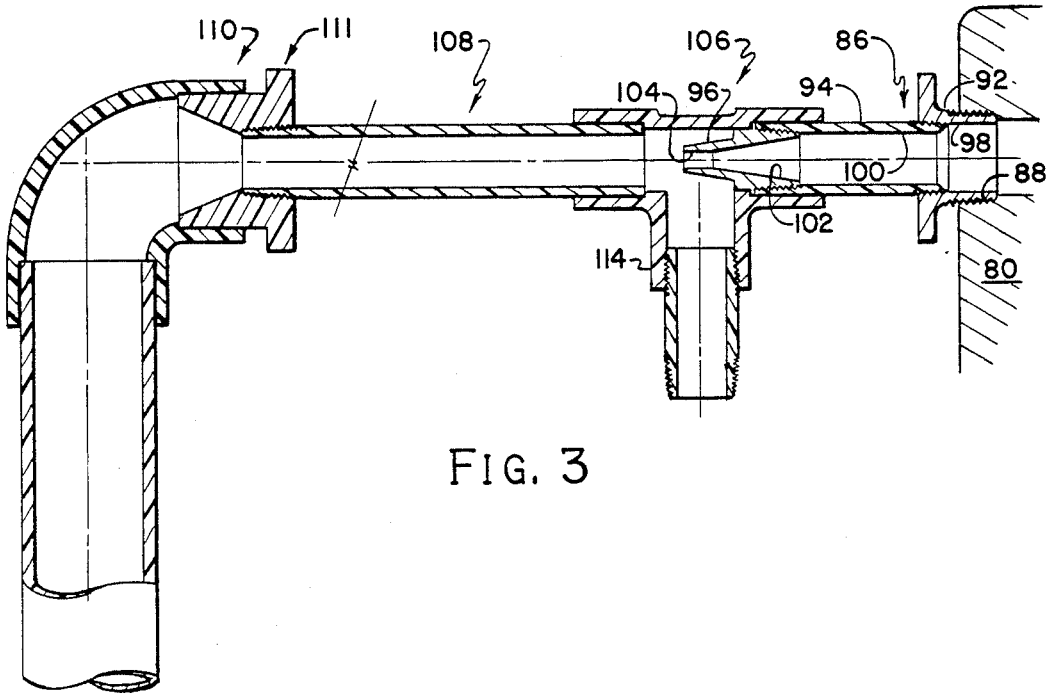
FIG. 3 is an enlarged vertical cross-sectional view of the jet pump of FIG. 2.

The surface installation 50 of this invention is shown somewhat schematically in FIG. 1 and in more detail in FIGS. 2 and 3. The installation 50 comprises, as major components, a tank 52, a pump-motor arrangement 54 having an inlet 56 taking water from the tank, a jet pump assembly 58 including a suction inlet 60 connected to the valved connection 28, and an outlet 62 delivering power liquid and gas to the tank 52.

Although the tank 52 may be of any suitable size and type, it preferably comprises a standard 55 gallon drum having a generally cylindrical closed side wall 64, a bottom 66 and an open top closed by a lid 70. The lid 70 desirably includes a standard bung opening in which a fitting 74 resides, sealing an intake conduit 76 with respect to the lid 70.

The pump-motor arrangement 54 may be of any suitable type and is illustrated as comprising a Universal Jet Pump, assembled by Jacuzzi of Little Rock, Arkansas. In the event greater detail is required of the pump-motor arrangement 54, reference is made to a publication entitled Owners Manual, dated 2/85. This particular pump includes a ½ hp electric motor 78 driving a centrifugal pump 80. The inlet 56 includes an ell 82 extending through the fitting 74 and connected to the conduit 76 and having a check or foot valve 84 at the end thereof. The foot valve 84 may be of any suitable type such as a Model 432, 1" Foot Valve made by Simmons Manufacturing Co. of McDonough, Georgia.

The pump 80 delivers its output through a power fluid nozzle 86 threaded into an output 88 provided in the body of the pump 80. The power fluid nozzle 86, as shown best in FIG. 3, is a composite member having a threaded collar or inlet end 92, an intermediate section 94 threaded into the collar 92 and a nozzle shaped outlet end 96 threaded onto the section 94. The interior passage through the nozzle 86 includes a generally cylindrical inlet end 98, a generally cylindrical intermediate section 100 of reduced diameter, an intermediate section 102 of frustoconical shape and an outlet nozzle section 104 of rather small diameter.

The section 94 are preferably made of polyvinyl chloride or other suitable organic polymeric material. The end of the section 94 is conveniently welded or glued into one end of the straight through section of a standard polyvinyl chloride tee 106. The other end of the straight through section of the tee 106 weldably receives an elongate nipple or conduit section 108 extending substantially across the width of the 55 gallon drum 52. The nipple 108 acts as the throat of the jet pump 58 and is longer than might be expected. At the designed pressure range and volume range of the surface installation 50, it has been found that an elongated throat enhances performance.

The nipple 108 connects to the inlet end of a swedge type ell 110 which can be simply made by threading or welding the end of the nipple 108 into an internally tapered bushing 111 of polyvinyl chloride welded into the ell 110. As shown best in FIG. 3, the internal diameter of the bushing 111 increases from the inlet end toward the outlet end thereof. Thus, the ell 110 acts as a diffuser for the jet pump 58 as well as part of the outlet 62 and directs the mixed fluids into a downcomer conduit 112 threaded or welded thereto. The conduit 112 extends downwardly through the drum lid 70 toward the bottom of the tank 52.

The offset leg 114 of the tee 106 comprises the suction inlet of the jet pump 58 and connects to a conduit 116 leading to the valved connection 28. If desired, a low pressure or vacuum gauge 117 may be provided in the conduit 116. A vacuum switch 118, in the conduit 116, senses the suction pressure of the jet pump 58 which, for all practical purposes, is the pressure in the annulus 30 at the surface. The switch 118 is connected by suitable electrical connectors 120 to the switch or relay 46 for manipulating the same.

In operation, the surface installation 50 is typically operated continuously by delivering electricity to the pump 78 through suitable conductors 122. After the pump 80 has been primed, operation of the motor 78 causes the pump 80 to withdraw power liquid from the tank 52 through the inlet conduit 76 and discharge power liquid into the nozzle 86 of the jet pump 58. The nozzle 86 delivers the power liquid at high velocity through the nozzle passage 104 into the cavity of the tee 106 and the nipple 108. This creates a low pressure area in the cavity of the tee 106 and exhausts gas from the annulus 30 of the well 10 through the conduit 116.

The power liquid from the nozzle 86 and the gas exhausting from the well 10 mix in the throat provided by the elongate nipple 108 and discharge through the swedge type ell 110 and downcomer 112 into the tank 52. Inside the tank 52, the gas from the annulus 30 separates from the power liquid, collects above the liquid level and exhausts through a vent tube 126 having the upper end thereof substantially above the motor 78. It will thus be seen that the tank 52 acts as a reservoir for the power liquid and also as a gas-liquid separator to separate any gas drawn off the well 10 from the power liquid, which is preferably fresh water but which may be crude oil, salt water, diesel or the like.

One of the characteristics of a jet pump is that the vacuum created at the suction 60 increases as the quantity of gas passing through the suction 60 declines. The ½ hp model of this invention routinely delivers volumes and pressures as shown in Table I:

TABLE I

| gas through the suction inlet 60 in scf/day | vacuum at the suction inlet 60 in " Hg |
|---|---|
| 5300 | 1" |
| 2000 | 11" |
| 1000 | 20" |
| 0 | 28". |

These volumes of produced gas are typical of a stripper oil well and, if a particular well produces more gas, a larger pump-motor assembly 54 and/or jet pump 58 will be employed to produce suction pressures similar to that shown in Table I. The surface assembly 50 has been installed at several stripper type wells and has increased the production thereof as one might expect from a decrease in back pressure acting against the formation 14 in a low pressure pumping oil well. The surprising observation is that the pressure at the suction inlet 60 declines to a low value while the pump jack motor 48 is off and rises when the pump jack 44 is turned on. As mentioned previously, one of the objects of this invention is to utilize this observation to control operation of the pump jack 44.

To this end, the switch 118 senses the pressure or vacuum in the conduit 116. This sensing corresponds to the suction pressure of the jet pump 58 or the surface pressure in the annulus 30. The switch or relay 46 is controlled by the sensing of the switch 118. As shown schematically in FIG. 4, the gas volume 128 above the fluid level 130 in the well 10 is at a minimum immediately prior to the pump jack 44 starting to pump. At this time, the pressure at the suction inlet 60 is at a minimum and the switch 118 senses a low value and the switch or relay 46 turns on to energize the motor 48 thereby commencing pumping operation. In terms of vacuum, the vacuum at the suction inlet 60 is at a high value when the switch 118 activates the relay 46 to turn the motor 48 on.

After the pump jack 44 has operated for a while and pumped much of the liquid in the well 10 up the tubing string 22, it has been noticed that the pressure at the suction inlet 60 rises to a value approaching atmospheric. In the wells observed, the suction pressure approaches a vacuum of 5–6" Hg after the well has pumped what appears to be the maximum amount of liquid for that particular pumping cycle. In accordance with this invention, the switch 118 senses a high suction pressure (or low vacuum) and manipulates the switch 46 to turn the pump motor 48 off. This corresponds to the situation in FIG. 5 where the gas volume 128 above the liquid level 130 is at a maximum.

The exact sensings of the switch 118 that are used to turn the motor 48 on and off will vary from well to well. In typical low volume stripper wells that produce only a small amount of gas, the low pressure cut on value will be on the order of 24" Hg vacuum and the high pressure cut off value will be on the order of 5–6" Hg vacuum. In wells which produce larger quantities of gas, the cut on and cut off values may tend to be higher, unless larger motors 78 or higher capacity jet pumps 58 are provided. The values of this parameter can be readily determined in the field by observing the sensed pressure values on the gauge 117 when the well pumps off and when the pump turns on with a conventional clock.

Although applicant has no desire to be confined to a particular theory of operation, it appears that there are two explanations for the rise in suction pressure toward atmospheric when approaching pump off. In a situation where the pump 38 is in the rat hole below the perforations 20, it seems evident that the liquid level 130 in the well has been lowered near or below the uppermost perforation 20 and fresh formation liquid, having a gas charge therein or gas from the uppermost perforation 20, is flowing into the interior of the casing string 16. If the gas is in solution, it comes out of solution, moves up the annulus and affects the jet pump 58 by increasing the suction pressure and increasing the discharge pressure.

In a situation where the pump 38 is above the perforations 20, the rise in suction pressure toward atmospheric when nearing pump off is an indication that fresh formation liquid is entering the bore hole, bringing with it a new charge of gas. The new charge of formation liquid mixes with the liquid in the casing 16 and, being subject to the low pressure in the annulus, releases some or all of the gas entrained which increases the suction pressure at the jet pump 58. In either event, operation of the pump jack 44 is controlled by a pressure sensing at the surface installation 50.

Figure 6:
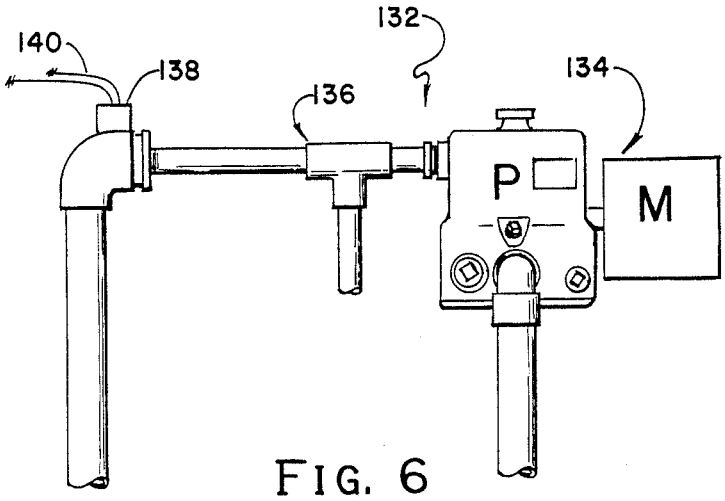
FIG. 6 is a schematic view of another embodiment of the surface installation of this invention.

It is well known that the discharge pressure in a jet pump is related to the amount of power fluid delivered therethrough, the design of the jet pump, and the suction pressure. Thus, as shown schematically in FIG. 6, a surface installation 132 includes a pump-motor arrangement 134 and jet pump 136 including a pressure switch 138 measuring the discharge pressure of the pump 136. The switch 138 includes one or more electrical conductors 140 for manipulating the switch or relay 46 to turn the pump jack motor 48 on and off. When the discharge pressure rises to a predetermined high value, the switch 138 turns the pump jack 44 off. When the discharge pressure falls to a predetermined low value, the switch 138 turns the pump jack 44 on. Thus, the switch 138 senses a different parameter indicative of a condition of the jet pump 136 and controls operation of the pump jack 44 in response thereto.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. In a pumping well of the type comprising a casing string extending from adjacent the surface of the earth into the earth to adjacent a subterranean formation, a tubing string inside the casing string and defining therewith an annulus, means for pumping formation liquids upwardly through the tubing string, and means for stopping the pumping means, the improvement comprising means for exhausting gas from the annulus comprising a pump arrangement including a pump suction connected to the annulus and exhibiting a measurable parameter representative of a condition of the pump;

means for sensing the parameter; and means responsive to the sensing means for energizing the stopping means for stopping the pumping means in response to the sensed parameter.

2. The pumping well of claim 1 wherein the measurable parameter is pressure and the sensing means comprises means for sensing pressure.

3. The pumping well of claim 2 wherein the sensing means comprises means for sensing the pressure in the annulus.

4. In a pumping well of the type comprising a casing string extending from adjacent the surface of the earth into the earth to adjacent a subterranean formation, a tubing string inside the casing string and defining therewith an annulus, means for pumping formation liquids upwardly through the tubing string, and means for stopping the pumping means, the improvement comprising means for exhausting gas from the annulus from the annulus and exhibiting a measurable pressure parameter representative of a condition of the exhausting means;

means for sensing the parameter; and means responsive to the sensing means for energizing the stopping means for stopping and restarting the pumping means in response to the sensed parameter.

5. The pumping well of claim 4 wherein the parameter is pressure, the sensing means comprises means for sensing pressure, the pressure varies in a given range between a low value and a high value, the means for starting the pumping means comprises means responsive to the low value.

6. In a pumping well of the type comprising a casing string extending from adjacent the surface of the earth into the earth to adjacent a subterranean formation, a tubing string inside the casing string and defining therewith an annulus, means for pumping formation liquids upwardly through the tubing string, and means for starting the pumping means, the improvement comprising means for exhausting gas from the annulus comprising a pump arrangement including a pump suction connected to the annulus and exhibiting a measurable parameter representative of a condition of the pump;

means for sensing the parameter; and means responsive to the sensing means for energizing the stopping means for starting the pumping means in response to the sensed parameter.

7. A method of pumping a well comprising a casing string extending into the earth from the surface to adjacent a subterranean formation, a tubing string inside the casing string and defining therewith an annulus, a downhole pump carried by the tubing string and means at the surface for operating the downhole pump, comprising the steps of pumping formation liquid up the tubing string with the downhole pump and concurrently exhausting gas out of the annulus at the surface and reducing the pressure in the annulus; and stopping pumping in response to rising pressure in the annulus at a predetermined pressure.

8. The method of claim 7 further comprising restarting pumping, after pumping has stopped, in response to falling pressure in the annulus at a second predetermined pressure lower than the first mentioned predetermined pressure.

9. The method of claim 8 wherein the exhausting step comprises exhausting gas out of the annulus and creating a vacuum in the annulus adjacent the surface, the second predetermined pressure being below atmospheric pressure.

10. The method of claim 9 wherein the first mentioned predetermined pressure is below atmospheric pressure.

11. A method of pumping a well comprising a casing string extending into the earth from the surface to adjacent a subterranean formation, a tubing string inside the casing string and defining therewith an annulus, a downhole pump carried by the tubing string and means at the surface for operating the downhole pump, comprising the steps of pumping formation liquid up the tubing string with the downhole pump and concurrently evacuating gas out of the annulus at the surface with a pump exhibiting a measurable parameter representative of a condition of the pump and thereby reducing the pressure in the annulus; and stopping pumping in response to changes in the parameter.

12. The method of claim 11 further comprising restarting pumping, after pumping has stopped, in response to changes in the parameter.

13. In a pumping well of the type comprising a casing string extending from adjacent the surface of the earth into the earth to adjacent a subterranean formation, a tubing string inside the casing string and defining therewith an annulus, means for pumping formation liquids upwardly through the tubing string, and means for stopping the pumping means, the improvement comprising means for exhausting gas from the annulus comprising a pump arrangement including a pump suction connected to the annulus and exhibiting a measurable pressure parameter representative of a condition of the exhausting means;

means for sensing the parameter comprising means for sensing the pump suction pressure; and means responsive to the sensing means for energizing the stopping means for stopping the pumping means in response to the sensed parameter.

14. In a pumping well of the type comprising a casing string extending from adjacent the surface of the earth into the earth to adjacent a subterranean formation, a tubing string inside the casing string and defining therewith an annulus, means for pumping formation liquids upwardly through the tubing string, and means for stopping the pumping means, the improvement comprising means for exhausting gas from the annulus and exhibiting a measurable pressure parameter representative of a condition of the exhausting means, the pressure parameter being variable in a given range between a low value and a high value;

means for sensing the parameter; and means responsive to the sensing means for energizing the stopping means for stopping the pumping means in response to the high value of the sensed parameter.

* * * * *